US008480198B2

(12) United States Patent
Nishizaka

(10) Patent No.: US 8,480,198 B2
(45) Date of Patent: Jul. 9, 2013

(54) IMAGE FORMING APPARATUS, CONTROL METHOD THEREFOR, AND MEDIUM STORING PROGRAM

(75) Inventor: Katsuhiko Nishizaka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 13/006,893

(22) Filed: Jan. 14, 2011

(65) Prior Publication Data

US 2011/0175957 A1 Jul. 21, 2011

(30) Foreign Application Priority Data

Jan. 15, 2010 (JP) ..... 2010-007227

(51) Int. Cl.
*B41J 29/38* (2006.01)
*B41J 2/165* (2006.01)

(52) U.S. Cl.
USPC ..... 347/12; 347/24; 347/35

(58) Field of Classification Search
USPC ..... 347/12, 35
See application file for complete search history.

(56) References Cited

U.S. PATENT DOCUMENTS 7,159,960 B2 * 1/2007 Nunokawa et al. ..... 347/14

FOREIGN PATENT DOCUMENTS

JP 2007-276139 A 10/2007

* cited by examiner

*Primary Examiner* — Uyen Chau N Le
*Assistant Examiner* — Kajli Prince
(74) *Attorney, Agent, or Firm* — Nutter McClennen & Fish LLP; John J. Penny, V.

(57) ABSTRACT

An image forming apparatus includes an ejection head having a plurality of nozzle arrays arranged in an orthogonal direction to an array direction thereof, a carriage on which the ejection head is loaded, and a moving unit that moves the carriage. The image forming apparatus further includes a control unit that controls the moving unit and the ejection head such that, when flushing is to be performed while the image is formed on a sheet as the carriage reciprocates, a liquid is ejected to an image forming region of the sheet from the plurality of nozzle arrays, the liquid is ejected to a first receiving area from a first nozzle array group disposed adjacent to an outward side, and the liquid is ejected to a second receiving area from a remaining second nozzle array group excluding the first nozzle array group and disposed adjacent to a homeward side.

8 Claims, 7 Drawing Sheets

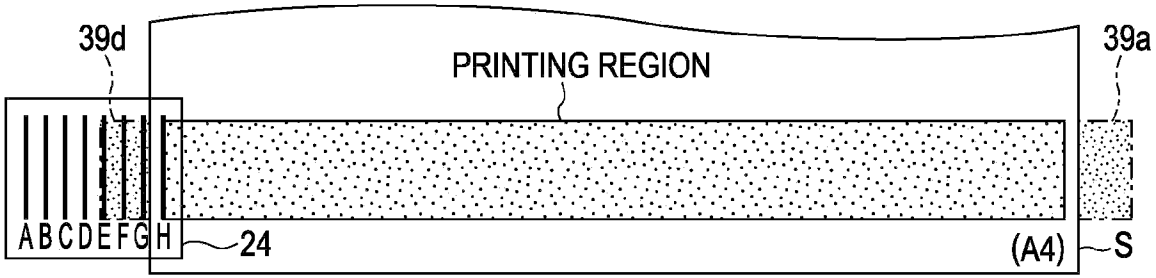
FIG. 5A
STOP POSITION FOR OUTWARD MOVEMENT
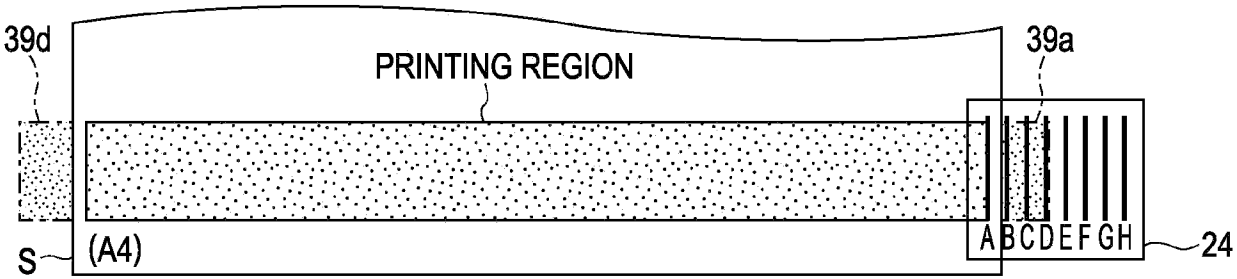
FIG. 5B
STOP POSITION FOR HOMEWARD MOVEMENT
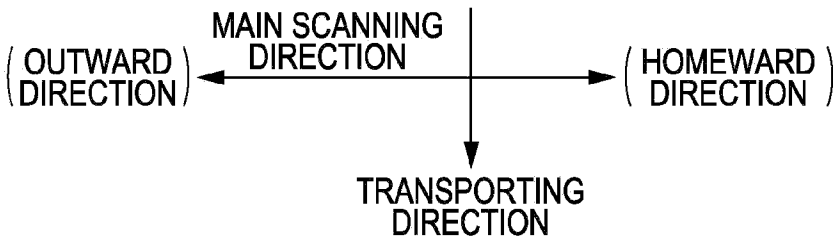

FLUSHING END POSITION

PRINTING END POSITION (STOP POSITION)

IMAGE FORMING APPARATUS, CONTROL METHOD THEREFOR, AND MEDIUM STORING PROGRAM

CROSS REFERENCES TO RELATED APPLICATIONS

The entire disclosure of Japanese Patent Application No. 2010-007227, filed Jan. 15, 2010, is expressly incorporated by reference herein.

BACKGROUND

1. Technical Field

The present invention relates to image forming apparatuses, control methods therefor, and media that store programs. In particular, the invention relates to an image forming apparatus that includes an ejection head having a plurality of nozzle arrays arranged in an orthogonal direction to an array direction thereof and a carriage on which the ejection head is loaded, and that forms an image on a sheet by ejecting a liquid from the ejection head while reciprocating the carriage in the orthogonal direction, a control method therefor, and a medium that stores a program for making a computer execute the control method for the image forming apparatus.

2. Related Art

As an example of an image forming apparatus of this type in the related art, JP-A-2007-276139 proposes an apparatus that forms an image by reciprocating a carriage, which is loaded with an ejection head that ejects ink, in a direction orthogonal to a transporting direction of a sheet. In this apparatus, a capping member capable of sealing the ejection head is disposed parallel to the moving direction of the carriage. When flushing is to be performed, the carriage reciprocating for image formation is moved to a position above the capping member without stopping. Then, ink is ejected from the ejection head using the capping member as a flushing area. Thus, the carriage can be moved smoothly to the flushing area, whereby the time required for flushing can be reduced.

Reducing the time required for flushing during image formation is considered as being an important factor for increasing the throughput for image formation.

SUMMARY

An advantage of some aspects of the invention is that an image forming apparatus, a control method therefor, and a medium storing a program that allow for more efficient flushing operation during image formation are provided.

The image forming apparatus, the control method therefor, and the medium that stores the program according to aspects of the invention employ the following solutions.

A first aspect of the invention provides an image forming apparatus that includes an ejection head having a plurality of nozzle arrays arranged in an orthogonal direction to an array direction thereof, and a carriage on which the ejection head is loaded. The image forming apparatus forms an image on a sheet by ejecting a liquid from the ejection head while reciprocating the carriage in the orthogonal direction. The image forming apparatus further includes a moving unit that moves the carriage; a liquid receiving unit that is provided to receive the liquid ejected outside the sheet when the image to be formed on the sheet has no margin, the liquid receiving unit having a first receiving area corresponding to a sheet edge located at a side toward which the carriage moves in an outward direction and a second receiving area corresponding to a sheet edge located at a side toward which the carriage moves in a homeward direction; and a control unit that controls the moving unit and the ejection head such that, when flushing is to be performed while the image is formed on the sheet as the carriage reciprocates, the liquid is ejected to an image forming region of the sheet from the plurality of nozzle arrays, the liquid is ejected to the first receiving area from a first nozzle array group disposed adjacent to an outward side, and the liquid is ejected to the second receiving area from a remaining second nozzle array group excluding the first nozzle array group and disposed adjacent to a homeward side.

In the image forming apparatus according to the first aspect of the invention, the moving unit and the ejection head are controlled such that, when flushing is to be performed while the image is formed on the sheet as the carriage loaded with the ejection head reciprocates, the liquid is ejected to the image forming region of the sheet from the plurality of nozzle arrays, the liquid is ejected from the first nozzle array group disposed adjacent to the outward side toward the first receiving area provided in correspondence to the sheet edge located at the side toward which the carriage moves in the outward direction, and the liquid is ejected from the remaining second nozzle array group, excluding the first nozzle array group and disposed adjacent to the homeward side, toward the second receiving area provided in correspondence to the sheet edge located at the side toward which the carriage moves in the homeward direction. Consequently, the distance by which the carriage is moved outside the image forming region for flushing can be reduced, whereby flushing can be performed more efficiently during image formation.

In the image forming apparatus according to the first aspect of the invention, at least one of the first receiving area and the second receiving area of the liquid receiving unit may be disposed in a plurality at positions corresponding to edges of sheets of different sheet sizes.

Furthermore, in the image forming apparatus according to the first aspect of the invention, the control unit may perform control such that the ejection of the liquid from the first nozzle array group to the first receiving area and the ejection of the liquid from the second nozzle array group to the second receiving area are performed in a single reciprocation cycle of the carriage.

Furthermore, in the image forming apparatus according to the first aspect of the invention, the plurality of nozzle arrays formed in the ejection head may include 2n nozzle arrays, n being a positive integer. In this case, the control unit may control first to n-th nozzle arrays as the first nozzle array group and (n+1)-th to 2n-th nozzle arrays as the second nozzle array group on the basis of the outward direction. Alternatively, in the image forming apparatus according to the first aspect of the invention, the plurality of nozzle arrays formed in the ejection head may include (2n+1) nozzle arrays, n being a positive integer. In this case, the control unit may control first to n-th nozzle arrays as the first nozzle array group and (n+1)-th to (2n+1)-th nozzle arrays as the second nozzle array group on the basis of the outward direction, or may control first to (n+1)-th nozzle arrays as the first nozzle array group and (n+2)-th to (2n+1)-th nozzle arrays as the second nozzle array group on the basis of the outward direction. Consequently, substantially half of the nozzle arrays can be flushed in each of the outward movement and the homeward movement of the carriage, whereby the distance by which the carriage is moved for flushing can be minimized.

Furthermore, in the image forming apparatus according to the first aspect of the invention, the control unit may perform control such that, when the carriage moves in the outward direction, the first nozzle array group is sequentially made to face the first receiving area starting from a nozzle array disposed at a leading end in the outward direction and the liquid is ejected sequentially from the nozzle arrays facing the first receiving area starting from the nozzle array disposed at the leading end in the outward direction, and may perform control such that, when the carriage moves in the homeward direction, the second nozzle array group is sequentially made to face the second receiving area starting from a nozzle array disposed at a leading end in the homeward direction and the liquid is ejected sequentially from the nozzle arrays facing the second receiving area starting from the nozzle array disposed at the leading end in the homeward direction. Consequently, flushing can be efficiently performed even if the first nozzle array group or the second nozzle array group cannot face the first receiving area or the second receiving area at once.

A second aspect of the invention provides a method for controlling an image forming apparatus that includes an ejection head having a plurality of nozzle arrays arranged in an orthogonal direction to an array direction thereof; a carriage on which the ejection head is loaded; a moving unit that moves the carriage; and a liquid receiving unit that is provided to receive a liquid ejected outside a sheet when an image to be formed on the sheet has no margin, the liquid receiving unit having a first receiving area corresponding to a sheet edge located at a side toward which the carriage moves in an outward direction and a second receiving area corresponding to a sheet edge located at a side toward which the carriage moves in a homeward direction. The image forming apparatus forms the image on the sheet by ejecting the liquid from the ejection head while reciprocating the carriage in the orthogonal direction. The method includes controlling the moving unit and the ejection head such that, when flushing is to be performed while the image is formed on the sheet as the carriage reciprocates, the liquid is ejected to an image forming region of the sheet from the plurality of nozzle arrays, the liquid is ejected to the first receiving area from a first nozzle array group disposed adjacent to an outward side, and the liquid is ejected to the second receiving area from a remaining second nozzle array group excluding the first nozzle array group and disposed adjacent to a homeward side.

In the method for controlling an image forming apparatus according to the second aspect of the invention, the moving unit and the ejection head are controlled such that, when flushing is to be performed while the image is formed on the sheet as the carriage loaded with the ejection head reciprocates, the liquid is ejected to the image forming region of the sheet from the plurality of nozzle arrays, the liquid is ejected from the first nozzle array group disposed adjacent to the outward side toward the first receiving area provided in correspondence to the sheet edge located at the side toward which the carriage moves in the outward direction, and the liquid is ejected from the remaining second nozzle array group, excluding the first nozzle array group and disposed adjacent to the homeward side, toward the second receiving area provided in correspondence to the sheet edge located at the side toward which the carriage moves in the homeward direction. Consequently, the distance by which the carriage is moved outside the image forming region for flushing can be reduced, whereby flushing can be performed more efficiently during image formation. Furthermore, a step for achieving any of the functions of the aforementioned image forming apparatus may be added.

A third aspect of the invention provides a medium that stores a program for making a computer execute the aforementioned method for controlling an image forming apparatus. The program may be stored in a computer-readable storage medium (such as a hard disk, a ROM, an FD, a CD, or a DVD), may be distributed from one computer to another via a transmission medium (e.g., a communication network such as the Internet or a LAN), or may be exchanged in any other form. Because the aforementioned method for controlling an image forming apparatus is executed by making the computer execute this program, advantages similar to those achieved by the aforementioned method can be achieved.

BRIEF DESCRIPTION OF THE DRAWINGS

The invention will be described with reference to the accompanying drawings, wherein like numbers reference like elements.

FIGS. 5A and 5B illustrate an example of stop positions of a carriage when printing is completed.

DESCRIPTION OF EXEMPLARY EMBODIMENTS

Figure 1:
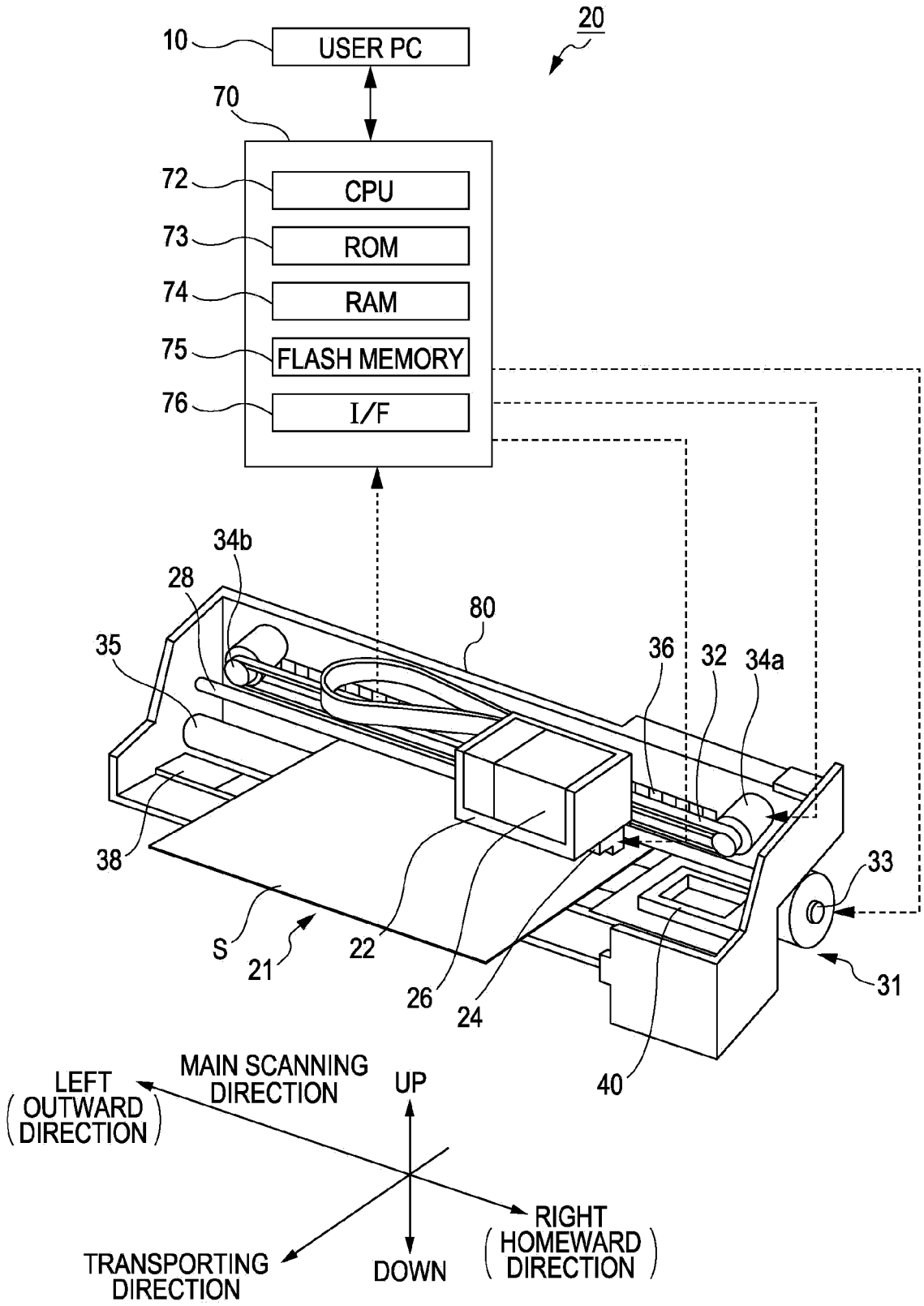
FIG. 1 schematically illustrates the configuration of an ink jet printer.
Figure 2:
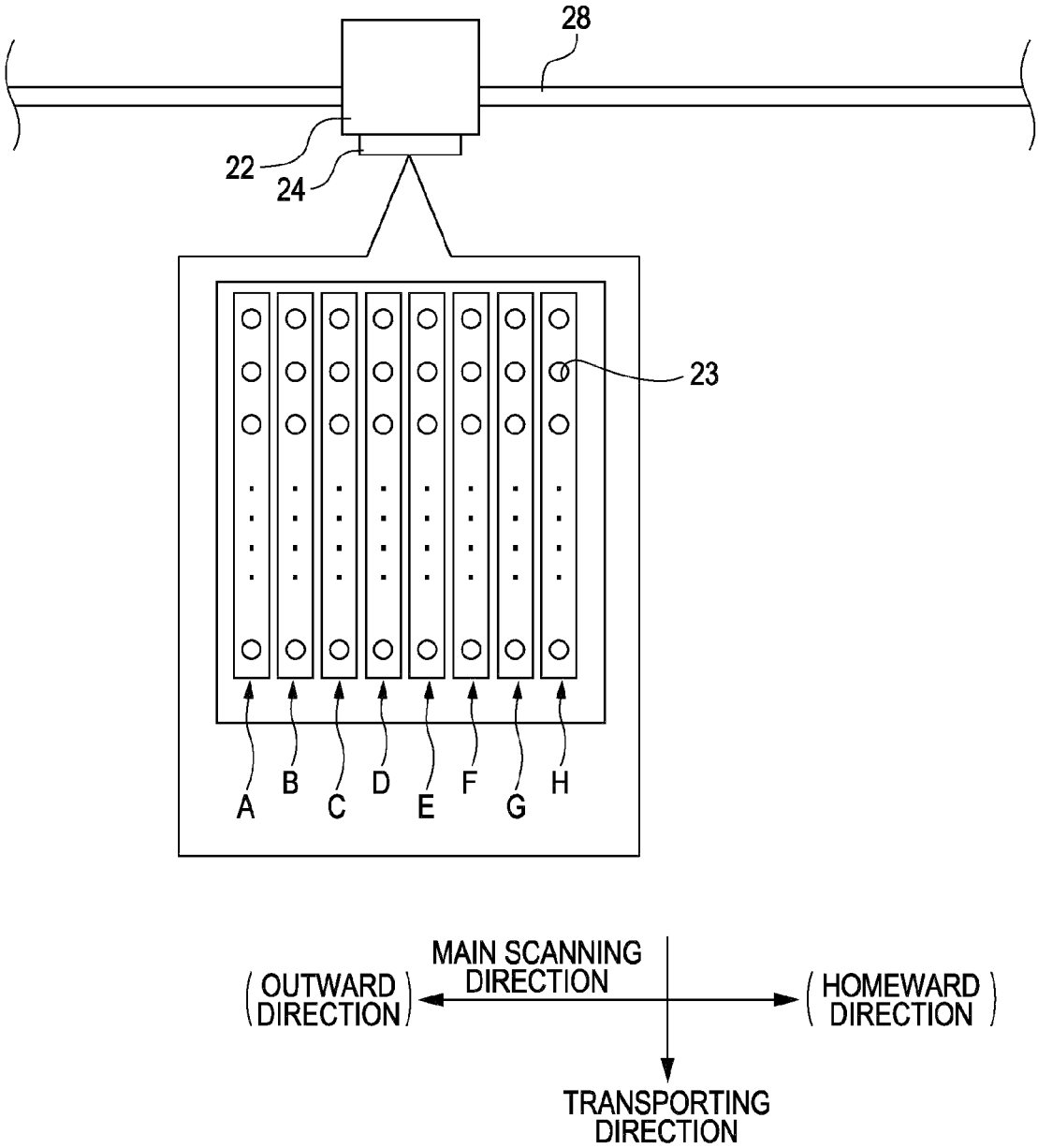
FIG. 2 illustrates an example of nozzle arrays formed in a print head.
Figure 3:
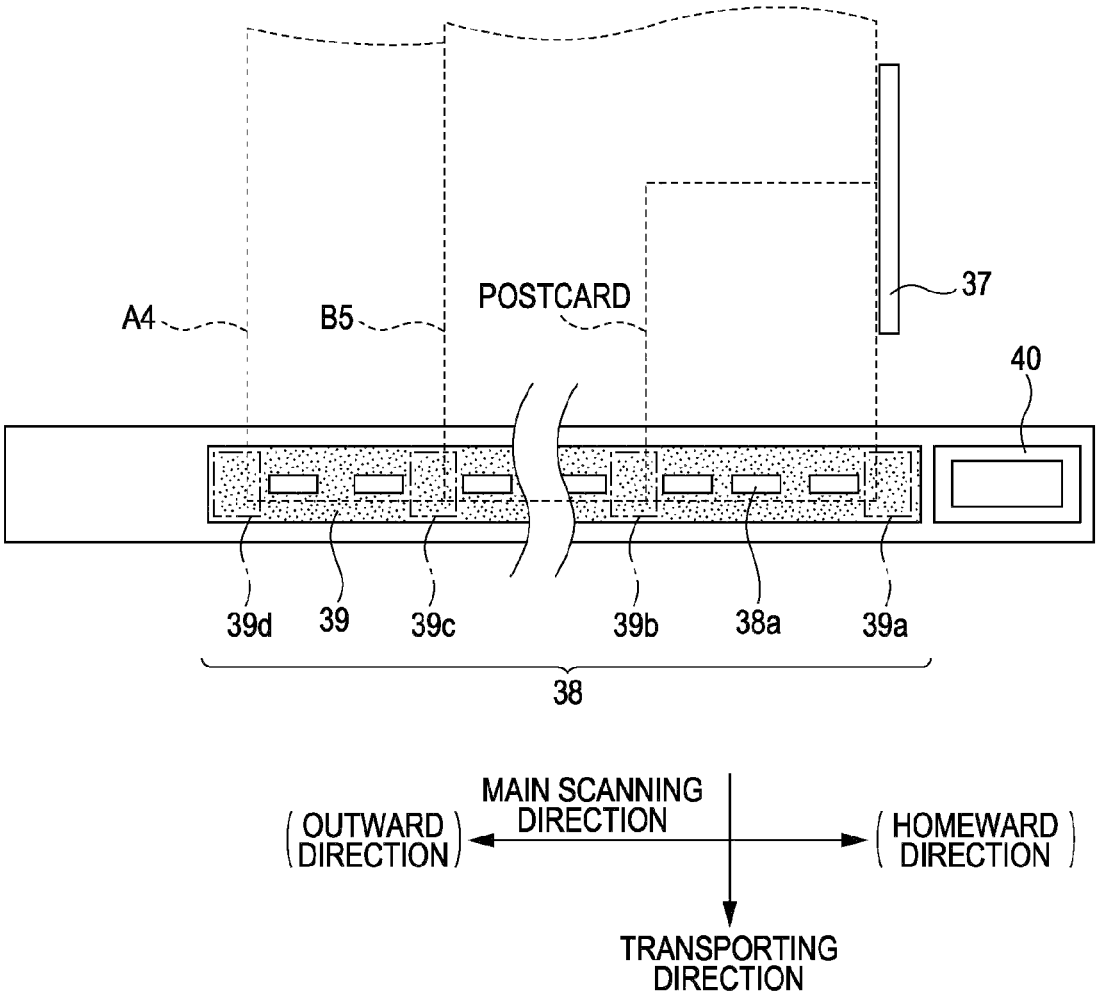
FIG. 3 schematically illustrates the configuration of a platen.

Next, an embodiment of the invention will be described with reference to the drawings. FIG. 1 schematically illustrates the configuration of an ink jet printer 20, which is an embodiment of an image forming apparatus according to this invention. FIG. 2 illustrates an example of nozzle arrays formed in a print head 24. FIG. 3 schematically illustrates the configuration of a platen 38.

As shown in FIG. 1, the ink jet printer 20 according to this embodiment includes a sheet feeding mechanism 31 that transports a sheet S from the back of the drawing toward the front (i.e., a transporting direction) when a sheet feeding roller 35 is driven by a driving motor 33; the platen 38 on which the sheet S fed by the sheet feeding mechanism 31 is placed; a printer mechanism 21 that performs printing by ejecting ink droplets from the print head 24 to the sheet S placed on the platen 38; a capping device 40 that is provided at the right end of the platen 38 in the drawing and seals the print head 24, and also cleans the print head 24, where necessary, by drawing out the ink therefrom by suction; and a controller 70 that controls the entire ink jet printer 20. A position above the capping device 40 is referred to as a home position.

The printer mechanism 21 includes a carriage motor 34*a* disposed at the right side of a mechanical frame 80; a driven roller 34*b* disposed at the left side of the mechanical frame 80; a carriage belt 32 bridged between the carriage motor 34*a* and the driven roller 34*b*; a carriage 22 that is driven by the carriage motor 34*a* via the carriage belt 32 so as to be reciprocated along a guide 28 in a left-right direction (i.e., a main scanning direction) that is orthogonal to the transporting direction of the sheet S; an ink cartridge 26 loaded on the carriage 22 and configured to individually accommodate cyan (C), magenta (M), yellow (Y), and black (K) color inks, each being a dye or a pigment as a coloring agent contained in water acting as a solvent; and the print head 24 that applies pressure to the inks supplied from the ink cartridge 26 so as to eject ink droplets. The leftward direction in FIG. 1 will be referred to as "outward direction" of the carriage 22, whereas the rightward direction in FIG. 1 will be referred to as "homeward direction". A linear encoder 36 for detecting the position of the carriage 22 is disposed on the rear surface of the carriage 22. This linear encoder 36 manages the position of the carriage 22. Although an on-carriage type in which the ink cartridge 26 is loaded on the carriage 22 is shown, an off-carriage type in which the ink cartridge 26 is disposed in a location other than the carriage 22 is also permissible.

As shown in FIG. 2, in the print head 24, each nozzle array has nozzles 23 that eject ink droplets of the corresponding one of CMYK colors and that are arrayed in the transporting direction of the sheet S. These nozzle arrays are arranged parallel to the main scanning direction. In this embodiment, a total of eight nozzle arrays are provided, and every two nozzle arrays eject ink droplets of one of the CMYK colors. As viewed from the outward direction (i.e., the left side in FIG. 2) of the carriage 22, there are nozzle arrays A to H arranged in that order. The print head 24 is of a type that deforms a piezo element by applying voltage thereto so as to apply pressure to the ink.

As shown in FIG. 3, the platen 38 is constituted of ribs 38*a* on which the sheet S is placed and an ink receiver 39 provided around the ribs 38*a* and composed of an ink absorbable material such as sponge or felt. The ribs 38*a* are arranged in the longitudinal direction of the platen 38 (i.e., the main scanning direction) so as to be capable of holding different kinds of sheets S with different sizes (e.g., A4-size, B5-size, and postcard-size) that can be used in the ink jet printer 20. Moreover, the ribs 38*a* are disposed at positions not aligned with the edges of the sheet S so that, when so-called no-margin printing in which a no-margin printing region is set for the sheet S is to be performed, the ink ejected outside the edges of the sheet S is prevented from adhering to the ribs 38*a*. The ink receiver 39 is capable of absorbing the ink ejected outside the sheet S when no-margin printing is performed. In this embodiment, the ink jet printer 20 is equipped with a reference guide 37 that guides the right edge (i.e., an edge at the homeward side) of the sheet S, such that the sheet S is transported with reference to the right edge thereof. Therefore, in the ink receiver 39, an area that absorbs the ink outside the right edge of the sheet S is served by an ink receiving area 39*a* regardless of the size of the sheet S. On the other hand, an area that absorbs the ink outside the left edge of the sheet S varies depending on the size of the sheet S. Specifically, the aforementioned area is served by an ink receiving area 39*b* when the sheet S is of a postcard-size, an ink receiving area 39*c* when the sheet S is of a B5-size, or an ink receiving area 39*d* when the sheet S is of an A4-size.

The controller 70 is a microprocessor having a CPU 72 as a central unit, and includes a ROM 73 that stores various kinds of processing programs and various kinds of data, a RAM 74 that temporarily stores data, a data writable/erasable flash memory 75, an interface (I/F) 76 used for exchanging information with an external device, and an input-output port (not shown). The RAM 74 is provided with a print buffer region that stores print data sent from a user PC 10, which is a general-purpose personal computer, via the I/F 76. The controller 70 receives, for example, a position signal and the like from the linear encoder 36 via the input port. The controller 70 outputs a driving signal to the print head 24, a driving signal to the driving motor 33, a driving signal to the carriage motor 34*a*, and the like via the output port.

When the ink jet printer 20 according to this embodiment having the above-described configuration receives dot data rendered in the user PC 10 as print data together with a print execution command, the ink jet printer 20 outputs the data and the command to the print buffer region provided in the RAM 74. Then, the sheet feeding roller 35 is rotated by the driving motor 33 so as to transport the sheet S onto the platen 38, and the carriage 22 is reciprocated by the carriage motor 34*a*. At the same time, the color inks are ejected by driving piezo elements (not shown) provided individually therefor in the print head 24 so that dots are formed, thereby forming an image on the sheet S. This ink jet printer 20 has a bidirectional print mode as a print mode. In the bidirectional print mode, printing is performed by ejecting ink droplets from the print head 24 during both the outward movement and the homeward movement of the carriage 22.

Figure 4:
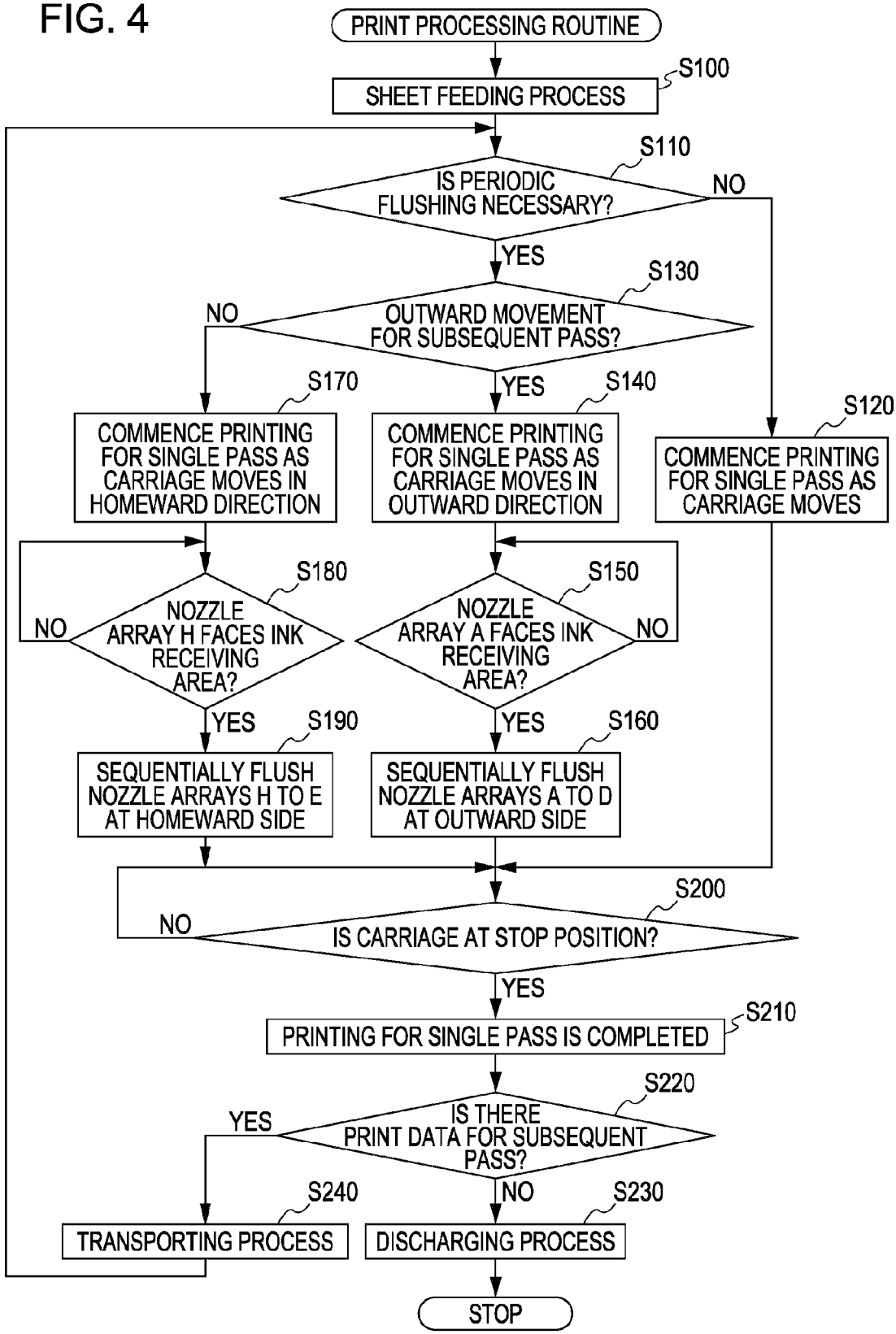
FIG. 4 is a flow chart illustrating an example of a print processing routine.

Next, the operation of the ink jet printer 20 according to this embodiment having the above-described configuration, specifically, the operation during print processing, will be described. FIG. 4 is a flow chart illustrating an example of a print processing routine executed by the controller 70. This routine is executed when print data is received from the user PC 10 under the bidirectional print mode. The sheet S used in this case is an A4-size sheet.

When this routine is executed, the CPU 72 in the controller 70 first performs a sheet feeding process in step S100 by controlling the driving motor 33 so as to drive the sheet feeding roller 35 and feed the sheet S onto the platen 38. Then, in step S110, it is determined whether or not periodic flushing is necessary. This determination is performed on the basis of whether or not a predetermined flushing timing has been reached. The predetermined flushing timing can be set to, for example, a time point corresponding to when a time period measured by a timer (not shown) from the start of the print processing or from the completion of the previous flushing performed on all of the nozzle arrays A to H reaches a predetermined time period.

If it is determined in step S110 that periodic flushing is not necessary, the processing proceeds to step S120 where printing is commenced for a single pass as the carriage 22 moves (outward or homeward). When the carriage 22 reaches a stop position in step S200, the carriage 22 is stopped, thereby completing the printing of the single pass in step S210. Examples of stop positions of the carriage 22 when printing is completed are shown in FIGS. 5A and 5B. The stop positions shown in FIGS. 5A and 5B correspond to when margin printing is performed on an A4-size sheet S. For the sake of convenience, the nozzle arrays A to H are shown with straight lines, and the ink receiving areas 39*a* and 39*d* are shown whereas the platen 38 and the ink receiver 39 are not shown. The same applies for FIGS. 6A to 7B to be described later. As shown in FIG. 5A, when the carriage 22 moves outward, the printing ends by stopping the carriage 22 at a position where the nozzle array H is positioned above an outward-side end of the printing region of the sheet S. On the other hand, as shown in FIG. 5B, when the carriage 22 moves homeward, the printing ends by stopping the carriage 22 at a position where the nozzle array A is positioned above a homeward-side end of the printing region of the sheet S. Although not shown, in the case of no-margin printing, the printing ends by stopping the carriage 22 at a position where all of the nozzle arrays A to H are positioned slightly outside the area of the sheet S for both the outward movement and the homeward movement of the carriage 22.

When the printing is completed for the single pass in this manner, it is determined in step S220 whether or not there is print data to be printed in a subsequent pass. If it is determined that there is no data to be printed in the subsequent pass, the driving motor 33 is controlled in step S230 so as to drive the sheet feeding roller 35 and discharge the sheet S from the platen 38, thereby ending the routine.

On the other hand, if it is determined that there is print data in step S220, the sheet S is transported by a predetermined distance for the printing of a subsequent pass in step S240, and the processing is repeated by returning to step S110. As the processing is repeated, if it is determined in step S110 that the predetermined flushing timing has been reached and periodic flushing is necessary, it is determined in step S130 whether or not the carriage 22 is to move in the outward direction for the subsequent pass. If it is determined that the carriage 22 is to move in the outward direction, the processing proceeds to step S140 where printing is commenced for a single pass as the carriage 22 moves outward, and then proceeds to step S150 so as to wait until the carriage 22 moves to a position at which the nozzle array A on the outward side faces the ink receiving area 39*d*. When the carriage 22 reaches this position at which the nozzle array A faces the ink receiving area 39*d*, since the nozzle arrays A to D on the outward side sequentially face the ink receiving area 39*d*, the print head 24 is controlled so as to eject the ink sequentially from the nozzle arrays A to D in step S160. Consequently, the nozzle arrays A to D can be flushed.

Figure 6A:
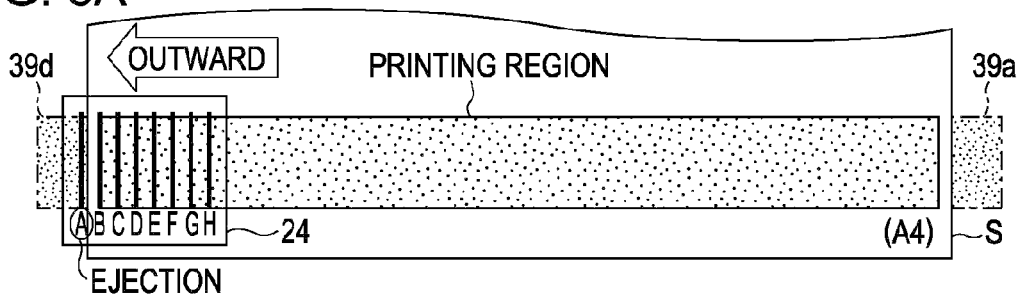
FIGS. 6A to 6D illustrate how the nozzle arrays are flushed.
Figure 6B:
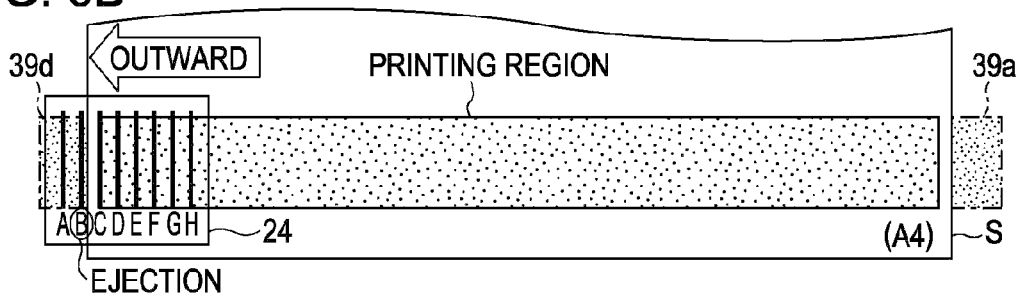
Figure 6C:
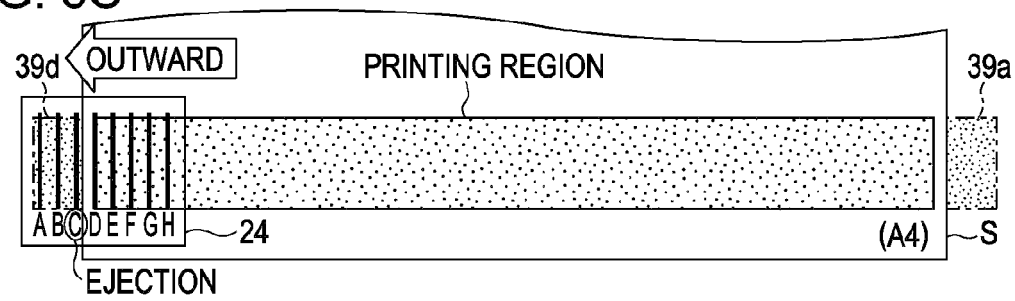
Figure 6D:
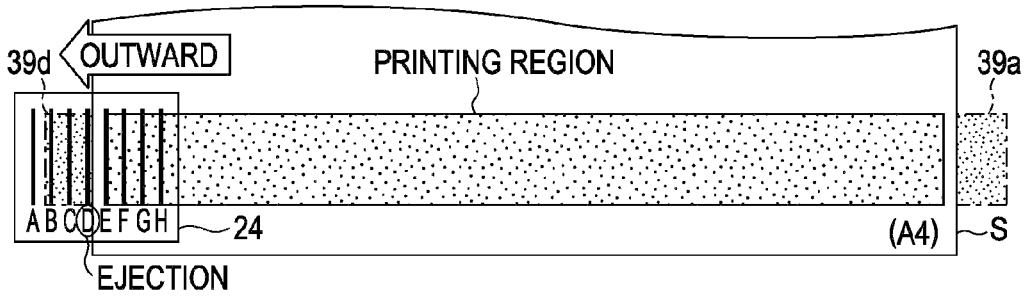
Figure 6D:
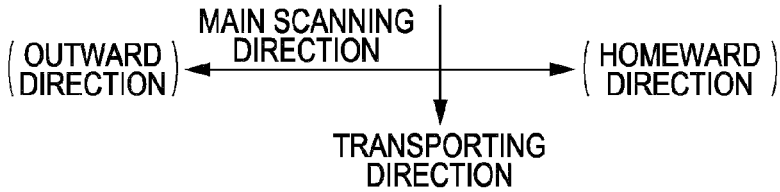

FIGS. 6A to 6D illustrate how the nozzle arrays A to D are flushed. When the nozzle array A faces the ink receiving area 39*d*, as shown in FIG. 6A, the nozzle array A ejects the ink toward the ink receiving area 39*d*. When the nozzle array B faces the ink receiving area 39*d*, as shown in FIG. 6B, the nozzle array B ejects the ink thereto. When the nozzle array C faces the ink receiving area 39*d*, as shown in FIG. 6C, the nozzle array C ejects the ink thereto. When the nozzle array D faces the ink receiving area 39*d*, as shown in FIG. 6D, the nozzle array D ejects the ink thereto. Since FIGS. 6A to 6D each illustrate a state where printing is being performed for a single pass in the outward direction, the print head 24 is controlled so that the ink is ejected from nozzle arrays required for the printing. Positions to be taken by the carriage 22 when the ink is to be ejected from the nozzle arrays A to D to the ink receiving area 39*d* are preset and stored in the ROM 73 on the basis of the moving speed of the carriage 22 and the ink ejection speed. The print head 24 is controlled such that, when the carriage 22 reaches the positions stored in the ROM 73, the ink is ejected from the corresponding nozzle arrays A to D. Although the sheet S is described as being an A4-size sheet as an example, the aforementioned flushing can be similarly performed when a B5-size or postcard-size sheet S is used. In the case of a B5-size sheet, the ink may be ejected to the ink receiving area 39*c*. In the case of a postcard-size sheet, the ink may be ejected to the ink receiving area 39*b*. After flushing the nozzle arrays A to D in this manner, if it is determined in step S200 that the carriage 22 has reached the corresponding stop position, the printing is completed for the single pass in step S210. Then, steps S220 and onward are executed.

On the other hand, if it is determined in step S130 that the carriage 22 is not to move in the outward direction for the subsequent pass, the processing proceeds to step S170 where printing is commenced for a single pass as the carriage 22 moves homeward, and then proceeds to step S180 so as to wait until the carriage 22 moves to a position at which the nozzle array H on the homeward side faces the ink receiving area 39*a*. When the carriage 22 reaches this position at which the nozzle array H faces the ink receiving area 39*a*, since the nozzle arrays H to E on the homeward side sequentially face the ink receiving area 39*a*, the print head 24 is controlled so as to eject the ink sequentially from the nozzle arrays H to E in step S190. Consequently, the nozzle arrays H to E can be flushed, whereby all of the nozzle arrays A to H can be flushed, together with the process in step S160. With regard to the flushing of the nozzle arrays H to E, positions to be taken by the carriage 22 when the ink is to be ejected to the ink receiving area 39*a* are preset and stored in the ROM 73 for the individual nozzle arrays H to E, as in the case of the flushing of the nozzle arrays A to D described above. The print head 24 is controlled such that, when the carriage 22 reaches the aforementioned positions, the ink is ejected from the corresponding nozzle arrays H to E. Step S160 and step S190 may be performed before or after each other. When the flushing of all of the nozzle arrays A to H is completed, the aforementioned timer is reset and begins a timekeeping process for determining a subsequent flushing timing. Therefore, if flushing of any of the nozzle arrays A to H on the outward side or the homeward side is not completed, it is determined in step S110 that periodic flushing is necessary. After flushing the nozzle arrays H to E in this manner, if it is determined in step S200 that the carriage 22 has reached the corresponding stop position, the printing is completed for the single pass in step S210. Then, steps S220 and onward are executed.

Figure 7A:
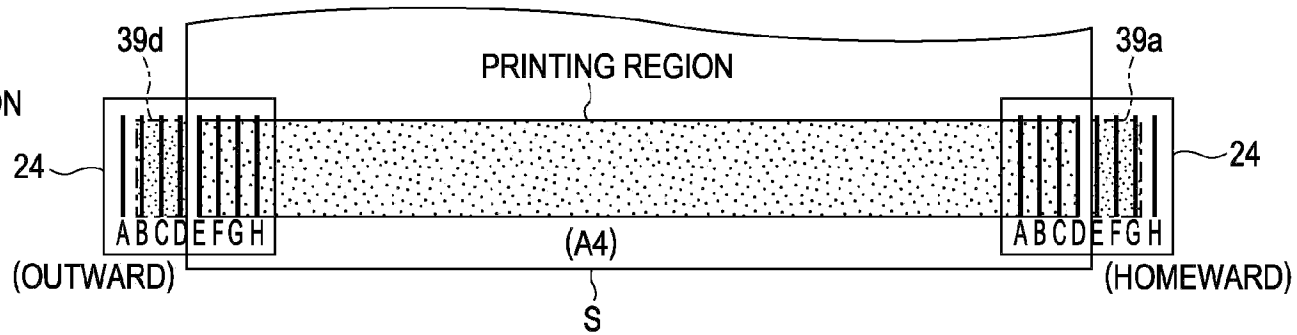
FIGS. 7A and 7B illustrate a comparison between flushing end positions and printing end positions.
Figure 7B:
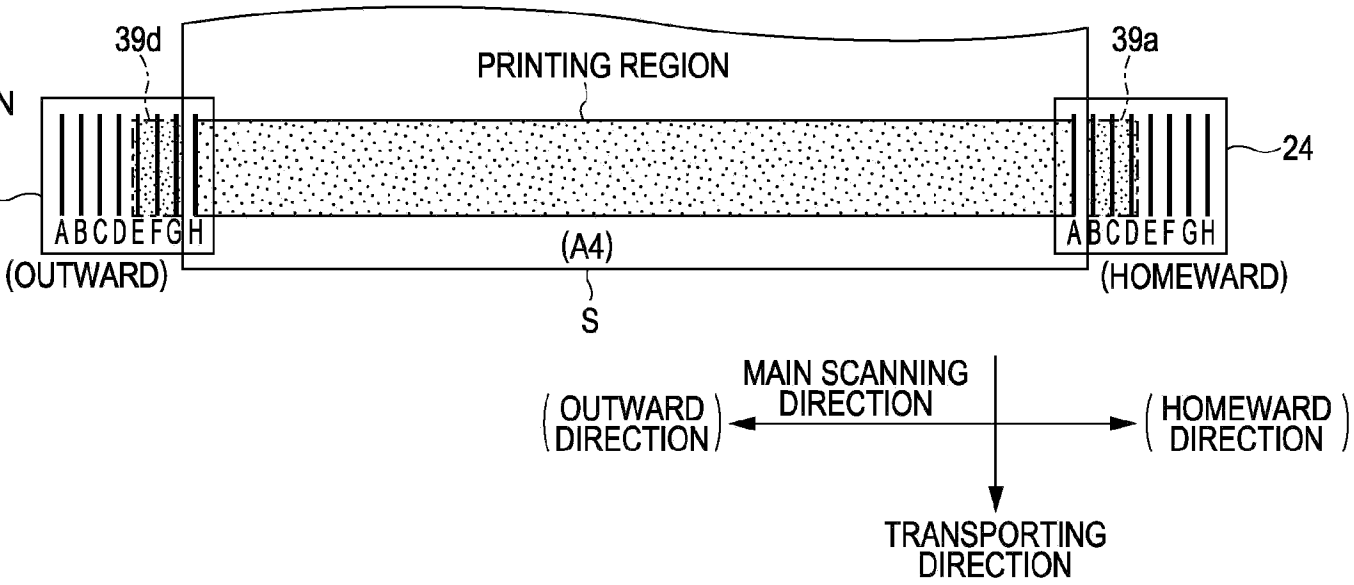

FIGS. 7A and 7B illustrate a comparison between flushing end positions and printing end positions. Specifically, FIG. 7A illustrates the flushing end positions, whereas FIG. 7B illustrates the printing end positions, that is, the stop positions of the carriage 22 shown in FIGS. 5A and 5B. As mentioned above, since the nozzle arrays A to D are flushed at the time of the outward movement, the flushing end position corresponds to that shown at the left side in FIG. 7A, whereas, since the nozzle arrays H to E are flushed at the time of the homeward movement, the flushing end position corresponds to that shown at the right side in FIG. 7A. On the other hand, regarding the printing end positions (i.e., the stop positions of the carriage 22), the position shown at the left side in FIG. 7B corresponds to the outward movement, whereas the position shown at the right side in FIG. 7B corresponds to the homeward movement. It is apparent from these drawings that the flushing end positions for both the outward movement and the homeward movement are located inward (toward the center) of the sheet S relative to the printing end positions, and that the carriage 22 does not need to be moved to a position outside the printing region to perform the flushing. Because half of the nozzle arrays disposed adjacent to the leading end of the carriage 22 in each of the outward movement and the homeward movement are flushed, the distance by which the carriage 22 is moved for flushing can be minimized and kept within a range of the distance by which the carriage 22 is moved for printing. Therefore, for example, as compared with a type that moves the carriage 22 to a position above the capping device 40 during printing to perform flushing, the distance by which the carriage 22 is moved for flushing can be reduced. As a result, flushing can be performed more efficiently during printing. Although the above description is directed to a case where margin printing is performed as an example, the flushing end positions are similarly located inward of the sheet S relative to the printing end positions in the case of no-margin printing. Therefore, flushing can be performed more efficiently during printing.

The relationship between the components in this embodiment and components according to the invention will be clarified below. The carriage belt 32, the carriage motor 34*a*, and the driven roller 34*b* for moving the carriage 22 in this embodiment correspond to a moving unit according to the invention. The ink receiver 39 having the ink receiving areas 39*b* to 39*d* as a first receiving area and the ink receiving area 39*a* as a second receiving area corresponds to a liquid receiving unit according to the invention. The controller 70 that executes the print processing routine in FIG. 4 corresponds to a control unit according to the invention.

With the ink jet printer 20 according to the embodiment described in detail above, if periodic flushing is necessary during printing, printing is commenced for a single pass as the carriage 22 moves in the outward direction in the case of outward movement, and flushing is performed by ejecting the ink sequentially from the nozzle arrays A to D to the ink receiving area 39*d* when the nozzle array A on the outward side faces the outward-side ink receiving area 39*d* for no-margin printing. In the case of homeward movement, printing is commenced for a single pass as the carriage 22 moves in the homeward direction, and flushing is performed by ejecting the ink sequentially from the nozzle arrays H to E to the ink receiving area 39*a* when the nozzle array H on the homeward side faces the homeward-side ink receiving area 39*a* for no-margin printing. Therefore, the nozzle arrays A to H of the print head 24 can all be flushed in a single reciprocation cycle of the carriage 22. Moreover, because half of the nozzle arrays disposed adjacent to the leading end of the carriage 22 in each of the outward movement and the homeward movement are flushed, the distance by which the carriage 22 is moved can be minimized. As a result, the distance by which the carriage 22 is moved for flushing can be reduced, whereby flushing can be performed efficiently during printing.

It should be noted that the invention is not limited to the above-described embodiment and allows various alternative modes within the technical scope of the invention.

Although the above embodiment is described as being applied to a case where printing is performed by using a bidirectional print mode as the print mode, the printing can alternatively be performed unidirectionally (e.g., outward direction) without using the bidirectional print mode. If printing is to be performed only in the outward direction, the carriage 22 may be simply moved in the homeward direction without performing the printing of the single pass in step S170 in the print processing routine in FIG. 4.

Although the flushing is performed by ejecting the ink in a one-by-one manner sequentially from the nozzle arrays that face the ink receiving area 39*a* or 39*d* in the above embodiment, the flushing may alternatively be performed by ejecting the ink collectively from multiple nozzle arrays.

Although eight nozzle arrays A to H are formed in the print head 24 in the above embodiment, the number of nozzle arrays is not limited so long as multiple nozzle arrays are formed therein. Furthermore, the nozzle arrays do not need to be provided in an even number, and may alternatively be provided in an odd number. In the case of an odd number of arrays, such as five nozzle arrays a to e, the nozzle arrays a to c may be flushed at the time of the outward movement, whereas the nozzle arrays e and d may be flushed at the time of the homeward movement, or the nozzle arrays a and b may be flushed at the time of the outward movement, whereas the nozzle arrays e to c may be flushed at the time of the homeward movement.

In the above embodiment, regarding the eight nozzle arrays A to H formed in the print head 24, the number of nozzle arrays to be flushed is the same, that is, four nozzle arrays, between the outward movement and the homeward movement. Alternatively, the number of nozzle arrays to be flushed may be different between the outward movement and the homeward movement. For example, the nozzle arrays A and B may be flushed at the time of the outward movement, and the nozzle arrays H to C may be flushed at the time of the homeward movement.

Although the stop positions of the carriage 22 are fixed in the above embodiment, the stop positions are not limited to a fixed type. For example, so-called logical seek may be performed by controlling the carriage 22 to change the stop position of the carriage 22 for each pass in accordance with the printing start position for a subsequent pass so that the carriage 22 is moved by a minimum distance for the current pass. In that case, if it is determined that periodic flushing is necessary, the logical seek is temporarily cancelled, and the flushing is performed after moving the carriage 22 to a flushable position. When the flushing is completed, the logical seek may be resumed. In this case, although the moving distance of the carriage 22 increases relative to that during logical seek, the moving distance can still be reduced as compared with a type that moves the carriage 22 to a position above the capping device 40 to perform flushing, whereby flushing can be performed efficiently during printing, as in the above embodiment.

Although flushing is performed in a single reciprocation cycle of the carriage 22 in the above embodiment, the flushing may alternatively be performed at the time of outward and homeward movements over multiple reciprocation cycles.

Although the predetermined flushing timing is set to a time point corresponding to when a predetermined time period has elapsed from the start of the print processing or from the completion of the previous flushing in the above embodiment, the predetermined flushing timing may alternatively be set to a time point corresponding to when printing processes for a predetermined number of passes have been performed since the completion of the previous flushing.

Although the sheet S is transported along the reference guide 37 with reference to the right edge of the sheet S, the sheet S may alternatively be transported with reference to the center thereof. In this case, the flushing may be performed by ejecting the ink to an outward-side ink absorbing area and a homeward-side ink absorbing area set for each sheet size.

Although the ink jet printer 20 is described in the above embodiment as an example of the image forming apparatus according to the invention, the invention is not limited thereto so long as the apparatus is configured to form an image on a sheet by ejecting a liquid, and may be applicable to an OA apparatus, such as a facsimile apparatus or a multifunction apparatus.

What is claimed is:

1. An image forming apparatus comprising:

an ejection head having a plurality of nozzle arrays arranged in an orthogonal direction to an array direction thereof;

a carriage on which the ejection head is loaded;

wherein an image is formed on a sheet by ejecting a liquid from the ejection head while reciprocating the carriage in the orthogonal direction, a moving unit that moves the carriage;

a liquid receiving unit that is provided to receive the liquid ejected outside the sheet when the image to be formed on the sheet has no margin, the liquid receiving unit having a first receiving area corresponding to a sheet edge located at a side toward which the carriage moves in an outward direction and a second receiving area corresponding to a sheet edge located at a side toward which the carriage moves in a homeward direction; and a control unit that controls the moving unit and the ejection head such that, when flushing is to be performed while the image is formed on the sheet as the carriage reciprocates, the liquid is ejected to an image forming region of the sheet from the plurality of nozzle arrays, the liquid is ejected to the first receiving area from a first nozzle array group disposed adjacent to an outward side, and the liquid is ejected to the second receiving area from a remaining second nozzle array group excluding the first nozzle array group and disposed adjacent to a homeward side.

2. The image forming apparatus according to claim 1, wherein at least one of the first receiving area and the second receiving area of the liquid receiving unit comprises a plurality of receiving areas disposed at positions corresponding to edges of sheets of different sheet sizes.

3. The image forming apparatus according to claim 1, wherein the control unit performs control such that the ejection of the liquid from the first nozzle array group to the first receiving area and the ejection of the liquid from the second nozzle array group to the second receiving area are performed in a single reciprocation cycle of the carriage.

4. The image forming apparatus according to claim 1, wherein the plurality of nozzle arrays formed in the ejection head includes 2n nozzle arrays, n being a positive integer, and wherein the control unit controls first to n nozzle arrays as the first nozzle array group and (n+1) to 2n nozzle arrays as the second nozzle array group.

5. The image forming apparatus according to claim 1, wherein the plurality of nozzle arrays formed in the ejection head includes (2n+1) nozzle arrays, n being a positive integer, and wherein the control unit controls first to n nozzle arrays as the first nozzle array group and (n+1) to (2n+1) nozzle arrays as the second nozzle array group on the basis of the outward direction, or controls first to (n+1) nozzle arrays as the first nozzle array group and (n+2) to (2n+1) nozzle arrays as the second nozzle array group.

6. The image forming apparatus according to claim 1, wherein the control unit performs control such that, when the carriage moves in the outward direction, the first nozzle array group is sequentially made to face the first receiving area starting from a nozzle array disposed at a leading end in the outward direction and the liquid is ejected sequentially from the nozzle arrays facing the first receiving area starting from the nozzle array disposed at the leading end in the outward direction, and performs control such that, when the carriage moves in the homeward direction, the second nozzle array group is sequentially made to face the second receiving area starting from a nozzle array disposed at a leading end in the homeward direction and the liquid is ejected sequentially from the nozzle arrays facing the second receiving area starting from the nozzle array disposed at the leading end in the homeward direction.

7. A method for controlling an image forming apparatus including an ejection head having a plurality of nozzle arrays arranged in an orthogonal direction to an array direction thereof; a carriage on which the ejection head is loaded; a moving unit that moves the carriage; and a liquid receiving unit that is provided to receive a liquid ejected outside a sheet when an image to be formed on the sheet has no margin, the liquid receiving unit having a first receiving area corresponding to a sheet edge located at a side toward which the carriage moves in an outward direction and a second receiving area corresponding to a sheet edge located at a side toward which the carriage moves in a homeward direction, wherein the image forming apparatus forms the image on the sheet by ejecting the liquid from the ejection head while reciprocating the carriage in the orthogonal direction, the method comprising:

controlling the moving unit and the ejection head such that, when flushing is to be performed while the image is formed on the sheet as the carriage reciprocates, the liquid is ejected to an image forming region of the sheet from the plurality of nozzle arrays, the liquid is ejected to the first receiving area from a first nozzle array group disposed adjacent to an outward side, and the liquid is ejected to the second receiving area from a remaining second nozzle array group excluding the first nozzle array group and disposed adjacent to a homeward side.

8. A non-transitory medium that stores a program for making a computer execute the method for controlling an image forming apparatus according to claim 7.

* * * * *